US007249914B2

(12) United States Patent
Due

(10) Patent No.: US 7,249,914 B2
(45) Date of Patent: Jul. 31, 2007

(54) SCRAPER APPARATUS AND METHOD

(76) Inventor: Joseph E. Due, 840 Grove St., Mauston, WI (US) 53948

( * ) Notice: Subject to any disclaimer, the term of this patent is extended or adjusted under 35 U.S.C. 154(b) by 0 days.

(21) Appl. No.: 11/502,211

(22) Filed: Aug. 10, 2006

(65) Prior Publication Data

US 2006/0269359 A1 Nov. 30, 2006

Related U.S. Application Data

(62) Division of application No. 11/136,828, filed on May 25, 2005, now Pat. No. 7,112,005.

(60) Provisional application No. 60/641,659, filed on Jan. 4, 2005.

(51) Int. Cl.
*E01C 7/12* (2006.01)

(52) U.S. Cl. ..... 404/75; 404/107

(58) Field of Classification Search ..... 404/107, 404/93, 94, 75

See application file for complete search history.

(56) References Cited

U.S. PATENT DOCUMENTS

| | | | | |
|---|---|---|---|---|
| 1,079,587 | A | 11/1913 | Anthony | |
| 1,442,544 | A | 1/1923 | Schwenke | |
| RE20,611 | E | 1/1938 | Nickerson | |
| 3,020,813 | A * | 2/1962 | Gross | 404/107 |
| 3,145,413 | A * | 8/1964 | Gunther | 401/266 |
| 3,347,138 | A * | 10/1967 | Lunde | 404/107 |
| 3,768,939 | A * | 10/1973 | Gramling | 425/87 |
| 4,048,735 | A | 9/1977 | Brunty | |
| 4,502,814 | A * | 3/1985 | Trimble | 404/107 |
| 4,511,283 | A | 4/1985 | Duval et al. | |
| 4,767,234 | A | 8/1988 | Rizzo | |
| 4,789,265 | A | 12/1988 | Wilson et al. | |
| 4,906,126 | A | 3/1990 | Wilson et al. | |
| 4,917,533 | A | 4/1990 | Wilson | |
| 5,325,994 | A | 7/1994 | Mizialko et al. | |
| 5,735,952 | A | 4/1998 | Wilson, Sr. | |
| 6,578,229 | B1 * | 6/2003 | Dziallas et al. | 15/236.05 |
| 6,624,232 | B2 | 9/2003 | Wilson, Sr. | |
| 2002/0192026 | A1 | 12/2002 | Somero et al. | |

FOREIGN PATENT DOCUMENTS

| | | |
|---|---|---|
| DE | 3619328 | 12/1987 |

* cited by examiner

*Primary Examiner*—Raymond Addie
(74) *Attorney, Agent, or Firm*—Merchant & Gould P.C.

(57) ABSTRACT

A scraper apparatus including a cart and a scraping arrangement located at a front of the cart. The scraping arrangement includes blades that are driven along a joint or crack by the cart to remove excess filling material deposited in the joint or crack of a working surface.

4 Claims, 13 Drawing Sheets

SCRAPER APPARATUS AND METHOD

CROSS-REFERENCE TO RELATED APPLICATIONS

This application is a divisional of U.S. application Ser. No. 11/136,828, now U.S. Pat. No. 7,112,005 filed May 25, 2005; which claims the benefit of U.S. Provisional Application No. 60/641,659 filed on Jan. 4, 2005; which applications are incorporated herein by reference.

TECHNICAL FIELD

The principles disclosed relate to the operation and use of a scraper apparatus. More particularly, this disclosure concerns a scraper apparatus arranged to scrape crack-filling material.

BACKGROUND

Working surfaces commonly experience cracking due to any number of causes, such as wear, damage, weather conditions, or material composition of the work surface. To avoid further cracking and/or as a temporary fix in lieu of complete replacement, the cracks are repaired. Repairing the cracks often includes filling the cracks in the working surface with a filling material.

Similarly, working surfaces made of concrete material, for example, are often formed with control joints, also known as a construction joints or transition joints. These joints are provided to accommodate the expansion and contraction of the concrete material. It is often desirable to fill the control joints with a filling material that accommodates the expansion and contraction of the concrete material, while providing a uniformly flush working surface.

In concrete surface applications of either repairing a crack or filling a control joint, the filling material is typically a flowable or extrudable material that fills and hardens within the crack volume. When applying the filling material, a volume of filling material greater than the crack volume is often deposited within the crack to ensure that the entire crack is filled. Other types of filling materials are designed to expand beyond the volume defined by the crack to ensure that the entire crack is filled. In either case, workers are required to remove the excess filling material so that the top surface of the filling material is flush with the concrete working surface. Typically, this procedure requires the worker to use a hand scraper to scrape the excess filling material. Scraping excess hardened material by hand can be very laborious, as the worker is required to be on his hands and knees while manually scraping the hardened filling material. This type of work is tiring and sometimes causes back, knee, or other injury to the worker.

In general, improvement has been sought with respect to such devices and methods of crack repair.

SUMMARY

One aspect of the present disclosure relates to an automated scraper apparatus having a power-driven cart with scrapers configured to scrape concrete filling material. Another aspect of the present invention relates to a method of scraping concrete that preferably uses an automated scraper apparatus. Still another aspect of the present invention relates to various attachments and devices used in methods of repairing cracks or filling joints.

A variety of examples of desirable product features or methods are set forth in part in the description that follows, and in part will be apparent from the description, or may be learned by practicing various aspects of the disclosure. The aspects of the disclosure may relate to individual features as well as combinations of features. It is to be understood that both the foregoing general description and the following detailed description are explanatory only, and are not restrictive of the claimed invention.

DETAILED DESCRIPTION

With reference now to the various figures in which identical elements are numbered identically throughout, a description of various exemplary aspects of the present invention will now be provided.

Figure 1:
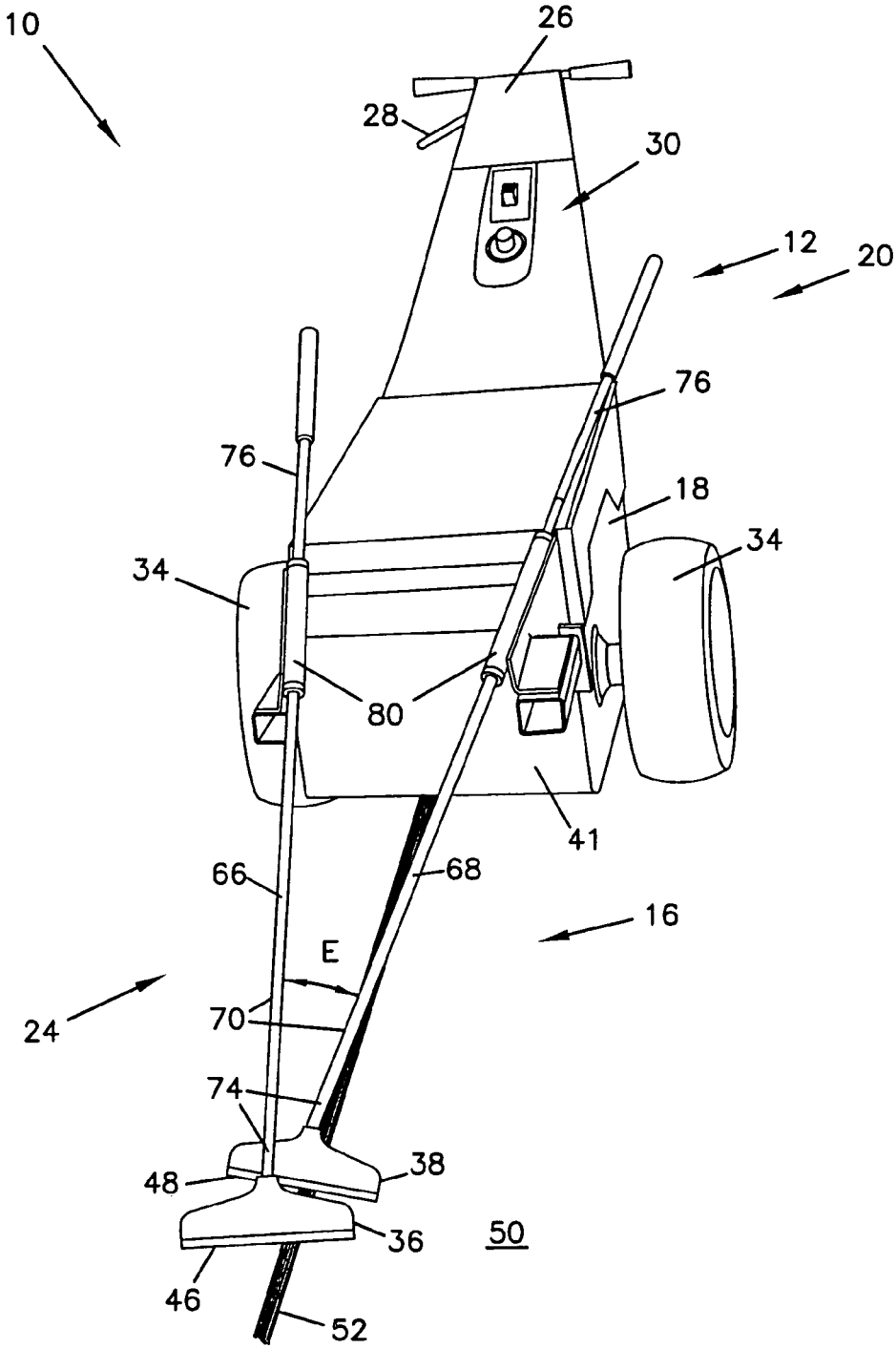
FIG. 1 is a front perspective view of one embodiment of a scraper apparatus having a scraping arrangement according to the principles of the present invention.

FIG. 1 illustrates a scraper apparatus or machine 10 that is an embodiment of the present invention. In general, the scraper apparatus 10 includes a cart 12 (i.e., a carriage, dolly, carrier) having wheels 34. The cart 12 is preferably a power-driven cart 12. That is, the cart 12 includes a motor and a drive mechanism. The power-driven cart 12 is controlled by an operator during scraping operations.

The cart 12 has a front region 24 and a rear region 20. For purposes of clarification, the front region 24 of the scraper apparatus 10 refers to the portion of the apparatus farthest from the operator during operation, and the rear region 20 of the scraper apparatus 10 refers to the portion of the apparatus closest to the operator during operation. A scraping arrangement 16 is mounted at the front region 24 of the cart 12. In use, the cart 12 of the scraper apparatus 10 is driven along a filled concrete control joint or crack 52 of a concrete working surface 50, for example. The scraping arrangement 16 scrapes excess portions 56 (FIG. 3) of a filling material 54 that has been deposited within the joint or crack 52 so that the scraped filling material 54 is level with the concrete working surface 50.

Figure 3:
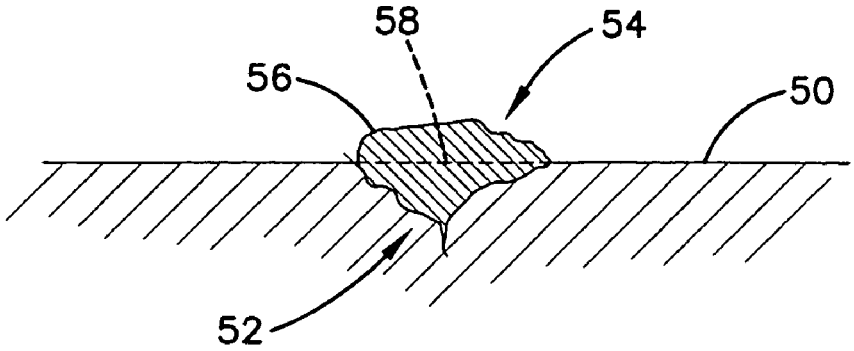
FIG. 3 is a cross-sectional view of crack-filling material deposited within a joint or crack of a concrete working surface.
Figure 5:
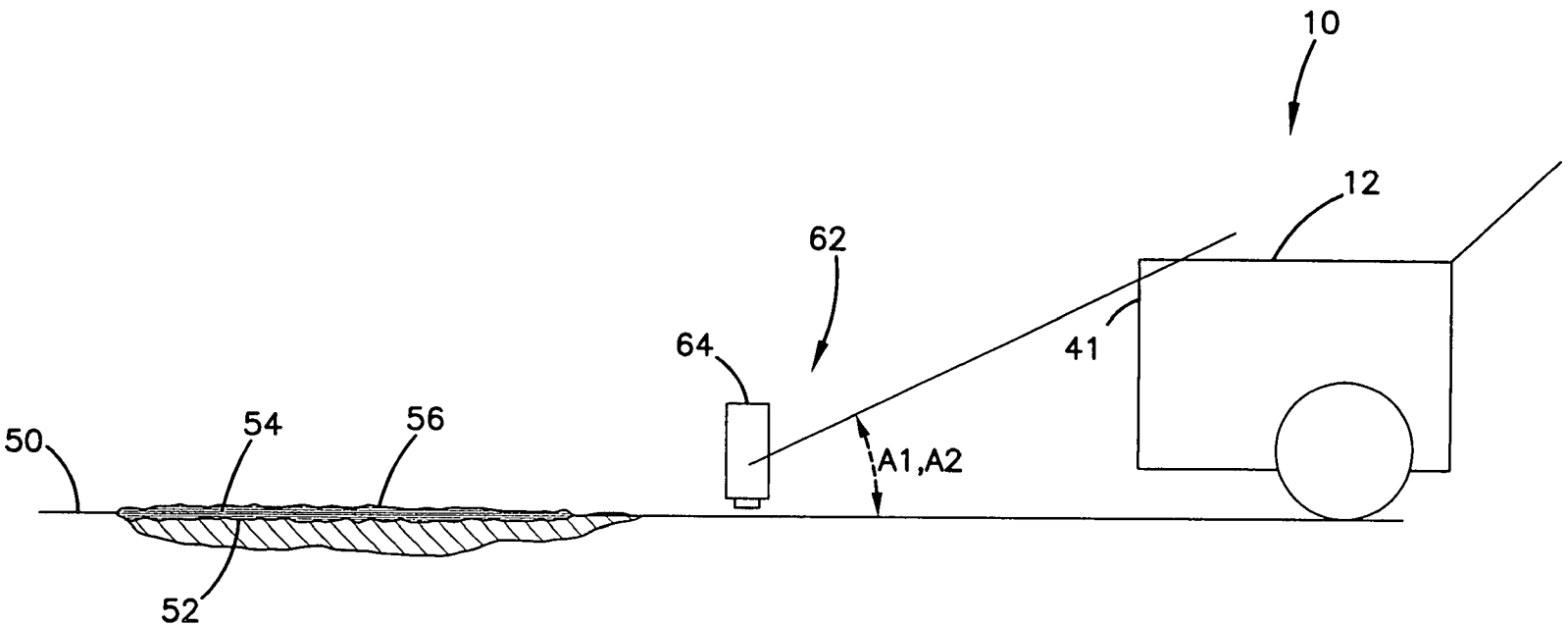
FIG. 5 is a side view of a schematic representation of the scraper apparatus, shown with a heating arrangement in lieu of the scraping arrangement of FIG. 4.

Although reference is made throughout the present disclosure to a concrete working surface and concrete filling material, it can be appreciated that the disclosed scraper apparatus 10 can be used on other types of working surfaces and with other types of filling materials. Also, although reference is made throughout the remaining disclosure to a control joint in a concrete working surface (such as shown in FIG. 1), it is to be appreciated that the disclosure also applies to repair of cracks in a concrete working surface (such as shown in FIGS. 3 and 5).

The cart 12 shown in FIG. 1 includes a main body 18 and a handle portion 26. In the illustrated embodiment, the motor and the drive mechanism of the power-driven cart 12 are enclosed within the main body 18. In other arrangements, the motor and drive mechanism may simply be mounted to a main body frame without being enclosed. The handle portion 26 of the cart 12 extends outward from the main body 18 of the cart. A drive lever 28 extending from the handle portion 26 is used to engage and disengage the drive mechanism to move or drive the power-driven cart 12. Other operating controls 30 are also located on the handle portion 26 of the cart 12. The wheels 34 of the cart 12 are coupled to the drive mechanism. In the illustrated embodiment, the wheels 34 include large rubber wheels that grip the concrete surface 50 to power or drive the cart 12 along the concrete surface 50 during scraping operation. The wheels 34 may include other types of wheels adapted to provide non-slip driving power during operation. Preferably, the wheels are made of a material that is non-marking so no wheel marks are left on the working surface. One suitable power-driven cart is manufactured by NuStar of Shakopee, Minn.

Figure 2:
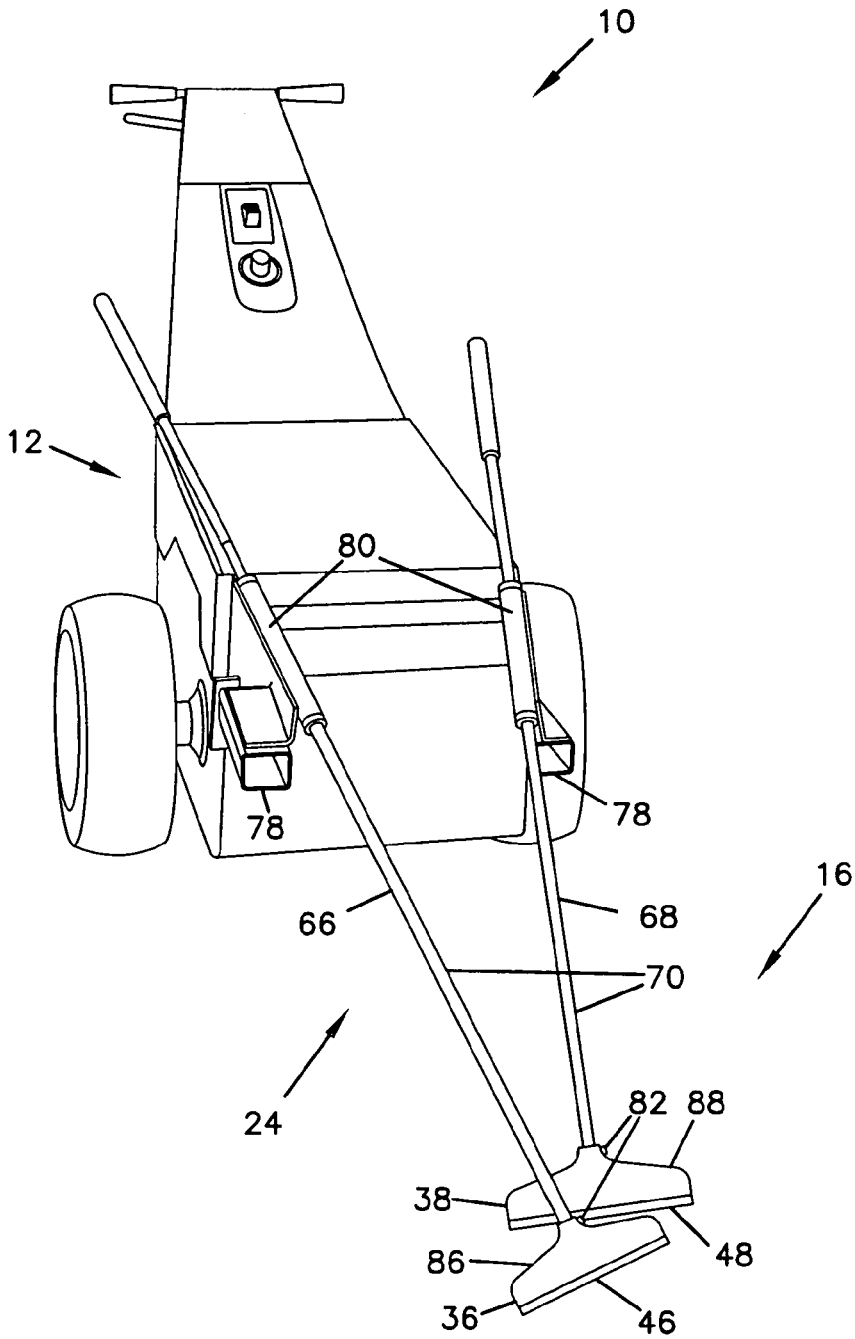
FIG. 2 is another front perspective view of the scraper apparatus of FIG. 1.

Referring now to FIGS. 1 and 2, the scraping arrangement 16 mounted at the front region 24 of the cart 12 includes at least one blade configured to contact the working surface 50 during operation of the scraper apparatus 10. In the illustrated embodiment, the scraping arrangement 16 includes first and second blades 36, 38.

Figure 4:
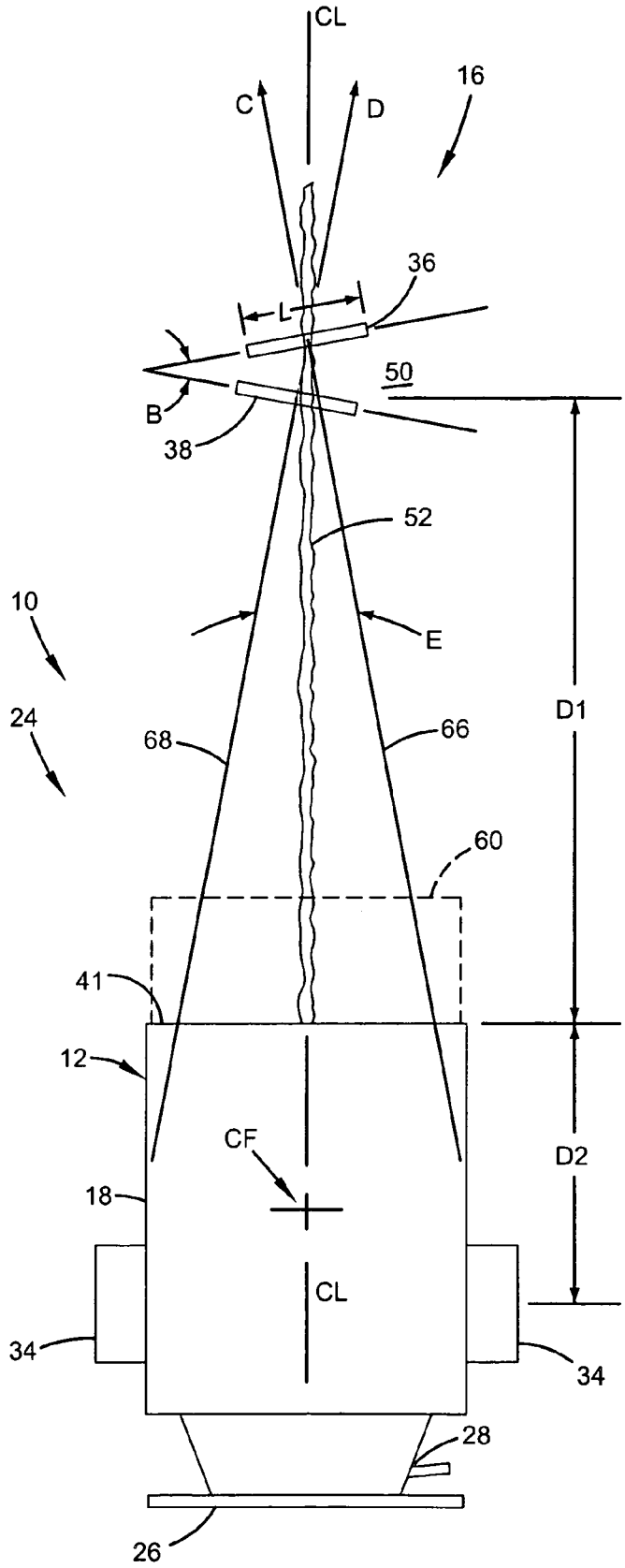
FIG. 4 is a top view of a schematic representation of the scraper apparatus of FIG. 1.

Referring to FIG. 4, the first and second blades 36, 38 each have a length L (only one blade dimension shown). In the illustrated embodiment, the length L of each of the blades 36, 38 is essentially the same. Other embodiments of the present disclosure may include blades of differing lengths. The length L of the blades 36, 38 is preferably between 4 and 12 inches; more preferably between about 6 and 10 inches. In the illustrated embodiment, the length L of the each of the blades is approximately 8 inches. Other sized blades corresponding to the application (e.g., type of working surface and filling material) can be used.

Referring back to FIGS. 1 and 2, each of the first and second blades 36, 38 of the scraping arrangement 16 includes a scraping edge 46, 48 that contacts the working surface 50. The scraping edges 46, 48 are configured to scrape the excess portions 56 (FIG. 3) of the filling material 54 to provide a material surface 58 that is generally flush with the working surface 50. In one embodiment, the blades 36, 38 and the scraping edges 46, 48 may be formed from stainless steel, or any other hardened and tempered steel having a structural strength sufficient to power scrape hardened filling material. In another embodiment, the scraping edges 46, 48 may be structurally strengthened by a hardened material or compound adhered or bonded to the blades 36, 38.

Referring now to FIGS. 2 and 5, in the illustrated embodiment, the scraping edges 46, 48 of the first and second blades 36, 38 are oriented at a non-perpendicular angle relative to the working surface 50. The non-perpendicular angle is represented by angles A1 and A2 in FIG. 5, although an alternative device other than the blades is shown (see also FIG. 11 generally). The angle A1, A2 is preferably an acute angle ranging from 10 degrees to 75 degrees. More preferably, the angle A1, A2 is less than about 45 degrees relative to the working surface 50. Orienting the blades 36, 38, and therefore the scraping edges 46, 48, at the acute angle A1, A2 provides an increased shearing force to more effectively remove the excess portions 56 of the filling material 54.

Referring now to FIGS. 2 and 4, the first and second blades 36, 38 are also oriented in a non-parallel relationship relative to one another. In particular, the first blade 36 is oriented at an angle B (FIG. 4) of between approximately 15 degrees and 45 degrees relative to the second blade 38. In the illustrated embodiment, the angle B of the first blade 36 relative to the second blade 38 is between approximately 20 degrees and 30 degrees. The first blade 36 is angled to face in a direction C relative to a centerline CL of the cart 12, while the second blade 38 is angled to face in a direction D relative to the centerline CL of the cart. The facing direction C of the first blade 36, relative to the centerline CL of the cart, is generally opposite the facing direction D of the second blade 38. In other words, each blade 36, 38 faces in a direction C, D toward an opposite side of the cart's centerline CL.

By orienting the blades at the non-parallel relationship relative to one another, and in the angled, facing directions C, D relative to the centerline CL of the cart 12, the scraping arrangement 16 is less likely to ride over a ridge, for example, formed in the excess portions 56 of the filling material 54. That is, what one of the blades 36, 38 may miss or ride over, the other will catch so that all or a substantial majority of the excess portions 56 of filling material 54 is effectively sheared and scraped by at least one of the blades 36, 38. By this arrangement, all or a substantial majority of the scraped material surface 58 is generally flush with the working surface 50.

Still referring to FIG. 4, the first blade 36 is positioned in front of or forward of the second blade 38; although the first blade can also be positioned behind or rearward of the second blade. The facing directions C, D of each of the blades 36, 38 are such that any loosened material is directed laterally outward from the centerline CL of the cart 12, rather than inwardly toward the operating path of the cart 12. Thereby, any material loosened by the forward first blade 36 does not affect the scraping operation of the rearward second blade 38.

Referring again to FIG. 1, each of the first and second blades 36, 38 is coupled to an extension member 66, 68. Each of the extension members 66, 68 includes a shaft 70 having a first end 74 and a second end 76. Preferably, each of the first and second blades 36, 38 is detachably coupled to the first end 74 of the respective shaft 70. In the illustrated embodiment, the blades 36, 38 are each mounted to the respective shaft 70 by a fastener 82 (FIG. 2) that extends through a head 86, 88 of each of the blades 36, 38. The fasteners 82 secure the blades to the respective shafts 70.

Because the blades are detachable, an operator can easily remove a blade when worn, or when the operator wishes to use the blade to manually scrape an area inaccessible to the cart 12. The detachable blade feature also permits a user to interchange blades of various sizes or materials, depending upon the application.

Referring back to FIG. 1, the second ends 76 of each of the shafts 70 of the extension members 66, 68 are secured to frame supports 78 located at the front region 24 of the cart 12. The frame supports 78 extend outward from the main body 18 of the cart 12. In the illustrated embodiment, mounting sleeves 80 are fixed to the frame supports 78. The second end 76 of each of the shafts 70 is positioned within and secured to one of the mounting sleeves 80.

The blades 36, 38 are coupled transversely to a longitudinal dimension of the extension members 66, 68. The extension members 66, 68 are non-parallel to one another. In particular, the extension members 66, 68 are oriented at an angle E (FIGS. 1 and 4) relative to one another; preferably the extension members 66, 68 are oriented at an angle E between approximately 15 degrees and 45 degrees. In the illustrated embodiment, the angle E of the extension members 66, 68 relative to one another is between approximately 20 degrees and 30 degrees. Accordingly, the perpendicular or transversely coupled blades 36, 38 are oriented in the corresponding angular position (angle B) relative to one another, as previously described.

Referring again to FIG. 1, preferably, at least one of the extension members 66, 68 is removable from the mounting sleeves 80. In the illustrated embodiment, both extension members 66, 68 are removable. This permits an operator to remove either of the extension members 66, 68 from the corresponding sleeve 80 to manually scrape the working surface in areas where, for example, the joints or cracks are hard to access with the scraper apparatus 10. Also, the removability feature permits an operator to easily replace or repair damaged or worn extension members and blades.

By mounting the blades 36, 38 at the first ends 74 of the extension members 66, 68, the blades 36, 38 are positioned a distance D1 (FIG. 4) forward of the cart 12. The distance D1 is sufficiently forward of the cart 12 so that an operator standing behind the cart 12 can view the blades 36, 38 and the control joint or crack 52 of the working surface 50 during operation. Referring to FIG. 4, the distance D1 is defined as the distance between a front side 41 of the main body 18 of the cart 12, and the scraping edge of the more rearward blade, i.e., the second blade 38. Preferably, the distance D1 is between 2.0 feet and 6.0 feet. In the illustrated embodiment, the distance D1 is between about 3.5 feet and 4.5 feet.

Preferably, the position at which the extension members 66, 68 mount relative to the mounting sleeves 80 is adjustable. That is, an operator can adjust the position of the extension members 66, 68 so that the distance D1 from the cart 12 at which the blades 36, 38 contact the working surface 50 is also adjustable. Adjusting or changing the location of the blades 36, 38 in relation to the cart 12 also changes the angle A1, A2 of the blades 36, 38 relative to the working surface.

For example, if the operator wishes to have a lesser angle A1, A2 of contact between the blades and the working surface, the operator can position the extension members 66, 68 within the mounting sleeves 80 (FIGS. 1 and 2) so that the blades 36, 38 are located a distance D1 farther out from the cart 12. The lesser the angle of contact, the more aggressive the shearing force. As previously discussed, the angle A1, A2 preferably ranges between 10 to 75 degrees; more preferably, less than about 45 degrees. Orienting the blade at an angle of less than 10 degrees, however, may diminish the effects of the blades' angle of contact and cause the blades to simple ride over the filling material.

In contrast, the operator may wish to locate the blades 36, 38 a distance D1 closer toward the cart 12 to orient the blades at an angle A1, A2 that is greater so that the shearing force is reduced. Increasing the angle A1, A2 of contact and reducing the shearing force may be desirable for some applications.

Still referring to FIG. 4, the wheels 34 of the scraper apparatus 10 are located a distance D2 rearward of the front side 41 of the main body 18 of the cart 12. Preferably, the distance D2 is such that the wheels are not located at a center fulcrum CF of the cart 12, rather the wheels 34 are rearwardly offset from the center fulcrum CF of the cart 12. The center fulcrum of the cart 12 is the fulcrum at which the cart's weight is evenly distributed forward and rearward of the fulcrum. Because the wheels 34 are rearwardly offset from the center fulcrum CF, the cart 12 has a tendency to tip or tilt forward. Accordingly, the blades 36, 38 of the scraping arrangement 16 act to stabilize and balance the scraper apparatus 10 during operation. The blades 36, 38 of the scraping arrangement 16 also thereby carry a portion of the weight of the cart 12. The portion of the cart's weight carried by the blades 36, 38 provides a downward force that, coupled with a driving force of the cart 12, effectively power scrapes hardened filling materials deposited in a control joint or crack.

In an alternative embodiment, a tray or platform 60 (shown schematically represented by dashed lines in FIG. 4) can be mounted or secured to the front region 24 of the cart 12 for placement of added weight. The added weight provides a greater downward force upon the scraping arrangement 16 for use in applications having filling material that is particularly hard or difficult to scrape. The platform 60 can be mounted to the frame supports 78 (FIG. 2) or to the extension members 66, 68, for example. The added weight can be permanently secured to the platform 60 or can be temporarily placed on the platform. One method of use includes placing a sandbag on the platform 60 to add weight and increase the downward force on the scraping arrangement 16.

Referring now to FIG. 5, in yet another embodiment, the scraper apparatus 10 may include a heating arrangement 62 (schematically represented). The heating arrangement 62 can be used in applications where heat is required to set or cure the filling material 54 before scraping can be performed. In this embodiment, the heating arrangement 62 is interchangeable with the scraping arrangement 16 (FIG. 4). That is, the heating arrangement 62 attaches to the frame supports 78 (FIG. 2) in a manner similar to that of the scraping arrangement 16.

The heating arrangement 62 includes a heater 64 (such as a propane tank, for example) that directs heat at the filling material 54 as the power-driven cart 12 moves along the control joint 52. Once the filling material 54 is sufficiently heated, the heating arrangement 62 is removed and replaced with the scraping arrangement 16. After the filling material has cured, the scraping arrangement 16 is driven along the control joint 52 by the power-driven cart 12 to remove the excess portion 56 of the filling material 54.

In general, the scraper apparatus 10 is used for repairing cracks or other structural defects formed a working surface, or filling control joints formed in a working surface. Often, the control joint or crack 52 is first cleaned to remove dirt and loose or fragmented concrete pieces. The control joint or crack 52 is then filled with filling material 54. Examples of filling material that can be used for concrete working surfaces include, for example, polysolphites, polyurethane, polyurea, epoxy, and rubber compounds. Other types of filling material for use on concrete surfaces or other types of working surfaces may also be used in accord with the principle disclosed.

In many applications, the amount or volume of the filling material 54 deposited within the control joint 52 is greater than the volume defined by the joint. Depositing a greater volume of filling material 54 ensures that the joint 52 is completely filled. Other filling materials may expand beyond the volume defined by the joint to ensure the joint is completely filled. After depositing the volume of filling material 54, the material is typically permitted to harden or cure. The heating arrangement 62 can be used to expedite the curing process or to activate a curing agent of the filling material, as previously described.

Once the filling material has hardened, the scraper apparatus 10 is used to remove the excess filling material 56 so that the top surface 58 (FIG. 3) of the filling material 54 is at most flush with the working surface 50. In particular, the scraping arrangement 16 of the scraper apparatus 10 is positioned to contact the excess filling material 56. The scraper apparatus 10 is driven forward along the joint 52 in a direction away from the operator. As the scraper apparatus 20 advances forward, the blades 36, 38 of the scraping arrangement 16 remove the excess 56 joint-filling material 54 located above the volume defined by the joint 52 in the working surface 50. The angling of the blades 36, 38 relative to one another, and relative to the working surface 50, function to shear and scrape the filling material 54 so that the remaining filling material is at or below the working surface 50.

Because the cart is automated, that is, power driven, scraping operations are made significantly less laborious than conventional methods. The operator can simply walk behind the cart 12 of the scraper apparatus while controlling the forward drive and direction the scraper apparatus 10. The scraper apparatus provides the shearing and scraping forces needed to remove excess, hardened filling material without the tiring efforts of conventional methods that can cause back, knee, or other injury.

Figure 6:
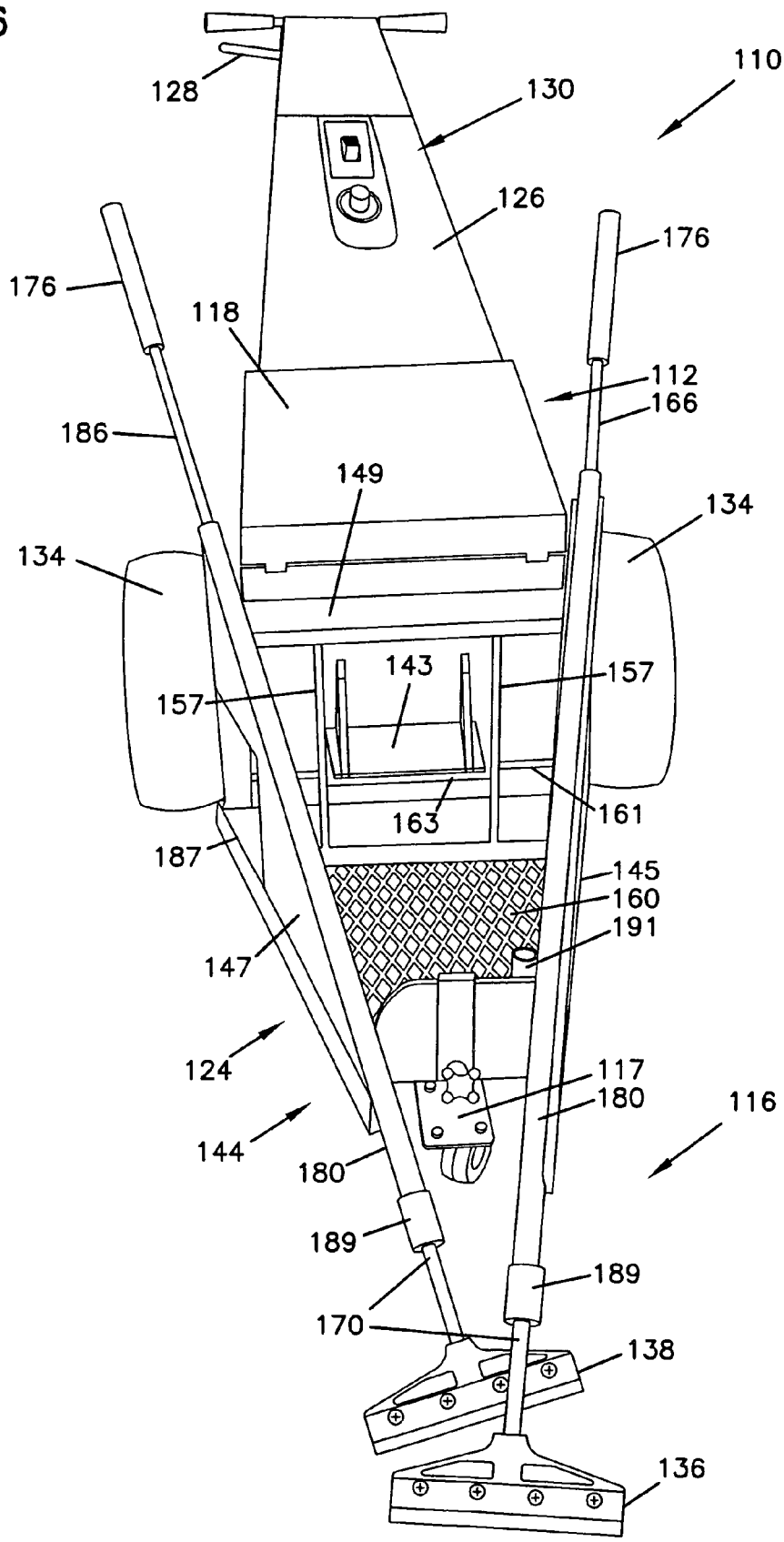
FIG. 6 is a front perspective view of another embodiment of a scraper apparatus having a scraping arrangement according to the principles of the present invention.

Referring now to FIG. 6, a second embodiment of a scraper apparatus or machine 110 of the present invention is illustrated. The scraper apparatus 110 is similar in construction and operation to the first embodiment of the scraper apparatus 10. For example, the scraper apparatus 110 generally includes a power-driven cart 112 and scrapper arrangement 116 similar to those previously described.

In particular, the cart 112 shown in FIG. 6 includes a main body 118, a handle portion 126, and wheels 134. In the illustrated embodiment, a motor and drive mechanism of the power-driven cart 112 are enclosed within the main body 118. A drive lever 128 extending from the handle portion 126 is used to engage and disengage the drive mechanism to move or drive the power-driven cart 112. Other operating controls 130 are also located on the handle portion 126 of the cart 112.

Figure 7:
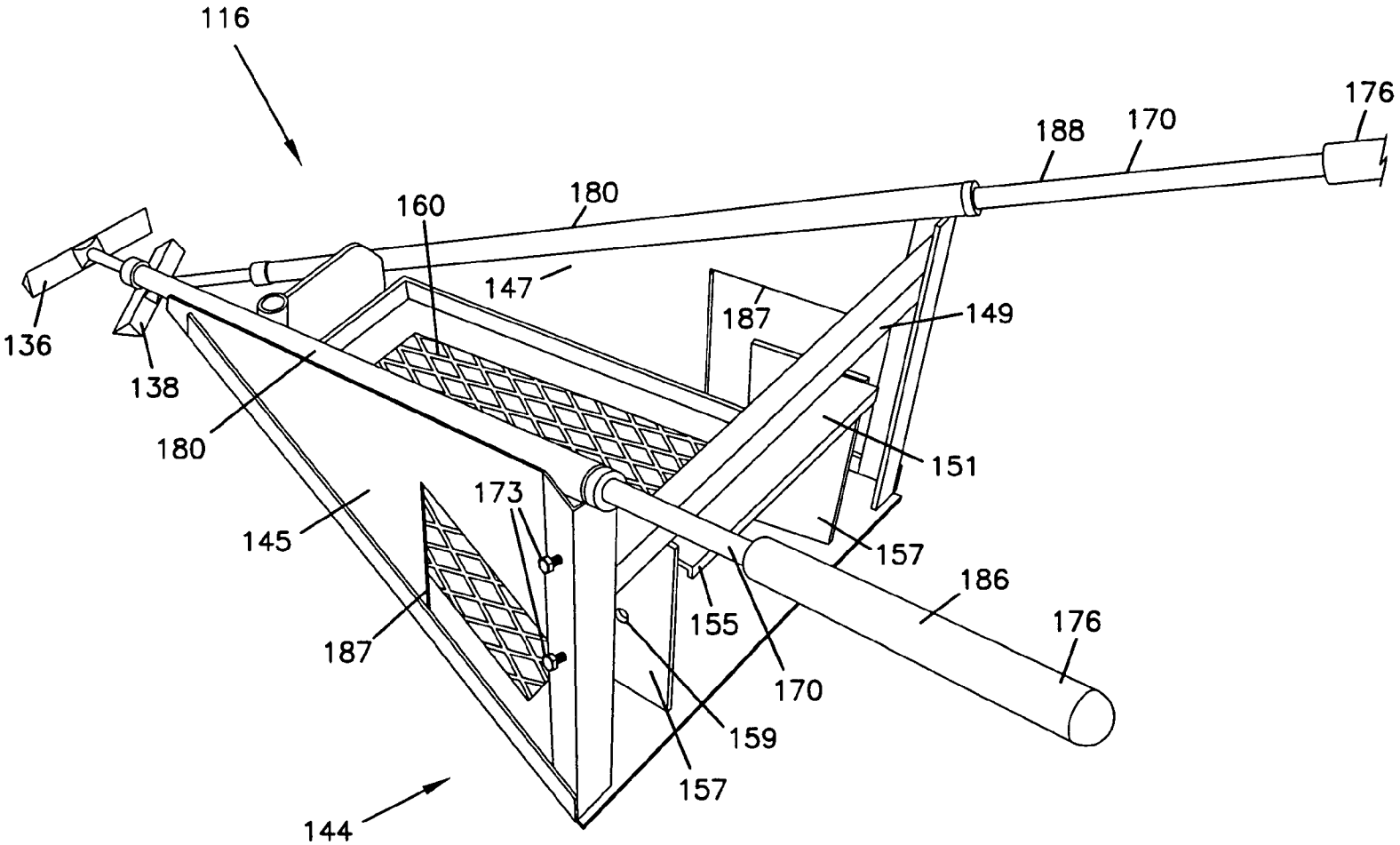
FIG. 7 is a rear perspective view of the scraping arrangement of FIG. 6 detached from a power cart of the scraper apparatus.
Figure 8:
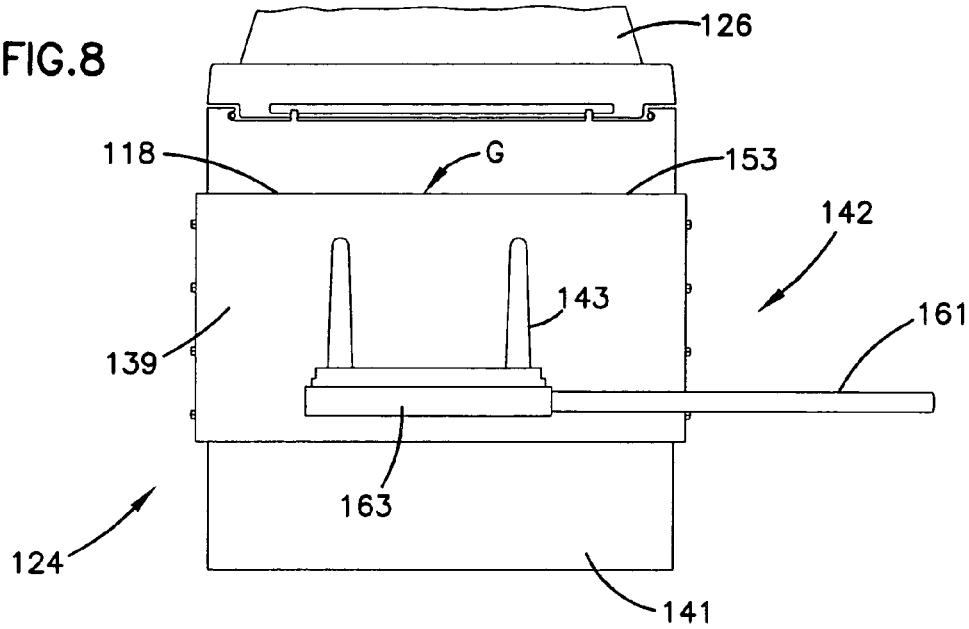
FIG. 8 is a partial front elevation view of the power cart of FIG. 6 shown without the scraping arrangement of FIG. 7.

Referring now to FIGS. 6–8, the scraping arrangement 116 is detachably mounted at a front region 124 of the cart 112. In particular, the scraping arrangement of the second embodiment includes a frame assembly 144 (FIG. 7) that detachably mounts to mounting structure 142 (FIG. 8). The mounting structure 142 is secure to a front side 141 of the main body 118 of the power-driven cart 112.

The frame assembly 144 of the scraping arrangement includes first and second side panels 145, 147, and a tray or platform 160 that extends between the first and second side panels 145, 147. Similar to the previous embodiment, the platform 160 can be used for placement of added weight, such as a sandbag, to provide a greater downward force upon the scraping arrangement 116.

A cross-support 149 extends between the first and second side panels 145, 147. An L-shaped mounting bracket 151 is affixed to the cross-support 149. The mounting bracket 151 is constructed to detachably mount to the mounting structure 142 of the cart 112. In particular, the mounting bracket 151 hooks onto a top edge 153 (FIG. 8) of the mounting structure 142. More specifically, a lip 155 (FIG. 7) of the mounting bracket fits within a gap G (see also FIG. 13) formed between the mounting structure 142 and the front side 141 of the cart 112 to detachably secure the scraping arrangement 116 to the front region 124 of the cart 112.

In the illustrated embodiment, the frame assembly 144 of the scraping arrangement 116 further includes vertical support members 157 that extend downward from the cross-support 149. The mounting structure 142 attached to the front side 141 of the cart 112 (FIG. 8) includes a front plate 139, and a sleeve 163 affixed to the front plate 139 by a bracket 143. Referring now to FIG. 6, when the frame assembly 144 is mounted to the mounting structure 142 of the cart 112, the horizontally oriented sleeve 163 fits between the vertical support members 157 of the frame assembly 144. More specifically, the sleeve 163 is positioned to align with holes 159 (only one shown in FIG. 7) formed in each of the vertical support members 157. A rod 161 (FIGS. 6 and 8) is inserted through the holes 159 formed in each of the vertical support members 157 and the sleeve 163 to secure the scraping arrangement 116 to the cart 112.

To detach or remove the scraping arrangement 116 from the cart 112, the rod 161 is removed from the sleeve 163 and the scraping arrangement 116 is lifted from the mounting structure 142. Windows 187 are formed in each of the first and second side panels 145, 147 to provide access to the holes 159 and the rod 161.

Figure 9:
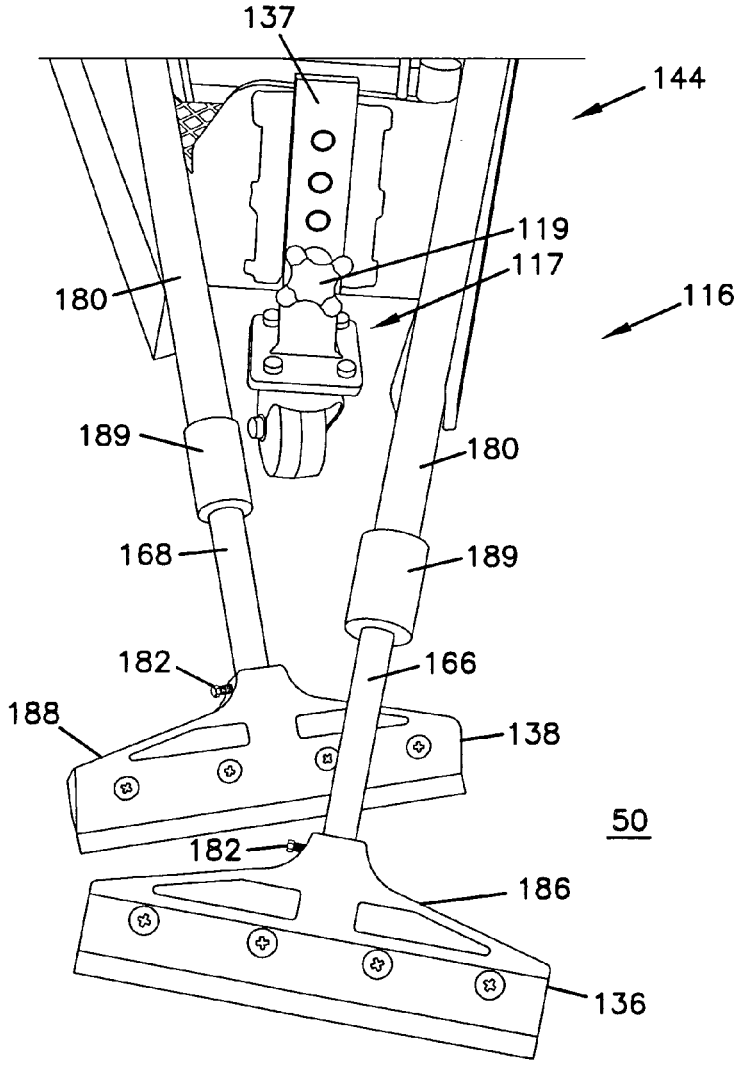
FIG. 9 is a front perspective view of a portion of the scraping arrangement shown in FIG. 7.

Referring now to FIGS. 6 and 9, the scraping arrangement 116 includes at least one blade configured to contact the working surface 50 during operation of the scraper apparatus 110. In the illustrated embodiment, the scraping arrangement 116 includes first and second blades 136, 138. Each of the first and second blades 136, 138 is coupled to an extension member 166, 168 (FIG. 9). The first and second blades 136, 138, and the extension members 166, 168 of the scraping arrangement are similar in construction (e.g., length L), orientation (e.g., angles A1, A2, B, and E), relative location (e.g., distance D1), and operation as previously described with respect to the first embodiment of the invention.

Still referring to FIG. 6, each of the extension members 166, 168 includes a shaft 170. The blades 136, 138 are each mounted to the respective shaft 170 by a fastener 182 (FIG. 9) that extends through a head 186, 188 of each of the blades 136, 138.

Referring to FIGS. 6 and 7, each of the shafts 170 of the extension members 166, 168 are inserted into mounting sleeves 180 that extend a majority of the length of the shafts 170. The mounting sleeves 180 are fixed to the side panels 145, 147 of the frame assembly 144. At least one of the extension members 166, 168 is removable from the mounting sleeves 180. In the illustrated embodiment, both extension members 166, 168 are removable. This permits an operator to remove either of the extension members 166, 168 from the corresponding sleeve 180 to manually scrape the working surface in areas where, for example, the joints or cracks are hard to access with the scraper apparatus 110.

Similar to the previous embodiment, the position at which the extension members 166, 168 mount relative to the mounting sleeves 180 is adjustable. That is, an operator can adjust the position of the extension members 166, 168 to correspondingly adjust the location of the blades 136, 138 in relation to the cart 112 (i.e. the distance D1 of FIG. 4). In the illustrated embodiment, mounting collars 189 are used to secure the extension members 166, 168 at a desired position.

As previously discussed with respect to the first embodiment, adjusting or changing the location of the blades 136, 138 in relation to the cart 112 also changes the angle A1, A2 of the blades 136, 138 relative to the working surface. Also similar to the previous embodiment, the wheels 134 of the scraper apparatus 110 are located a distance D2 (FIG. 4) rearward of the front side 141 of the cart 112 to provide a downward force that, coupled with a driving force of the cart 112, effectively power scrapes hardened filling materials deposited in a control joint.

Figure 10:
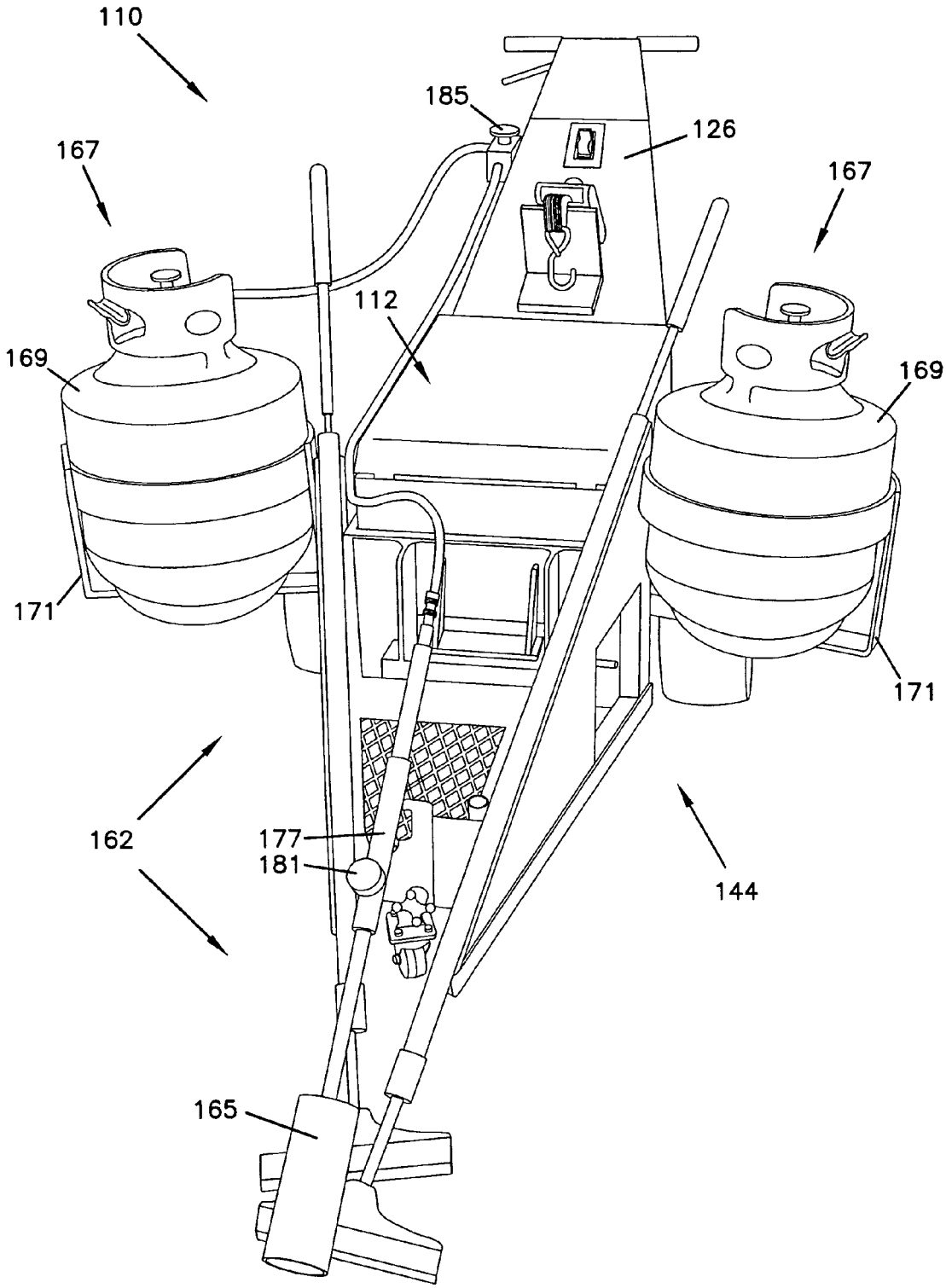
FIG. 10 is a front perspective view of the scraper apparatus of FIG. 6, shown with an alternative embodiment of a heating arrangement.
Figure 11:
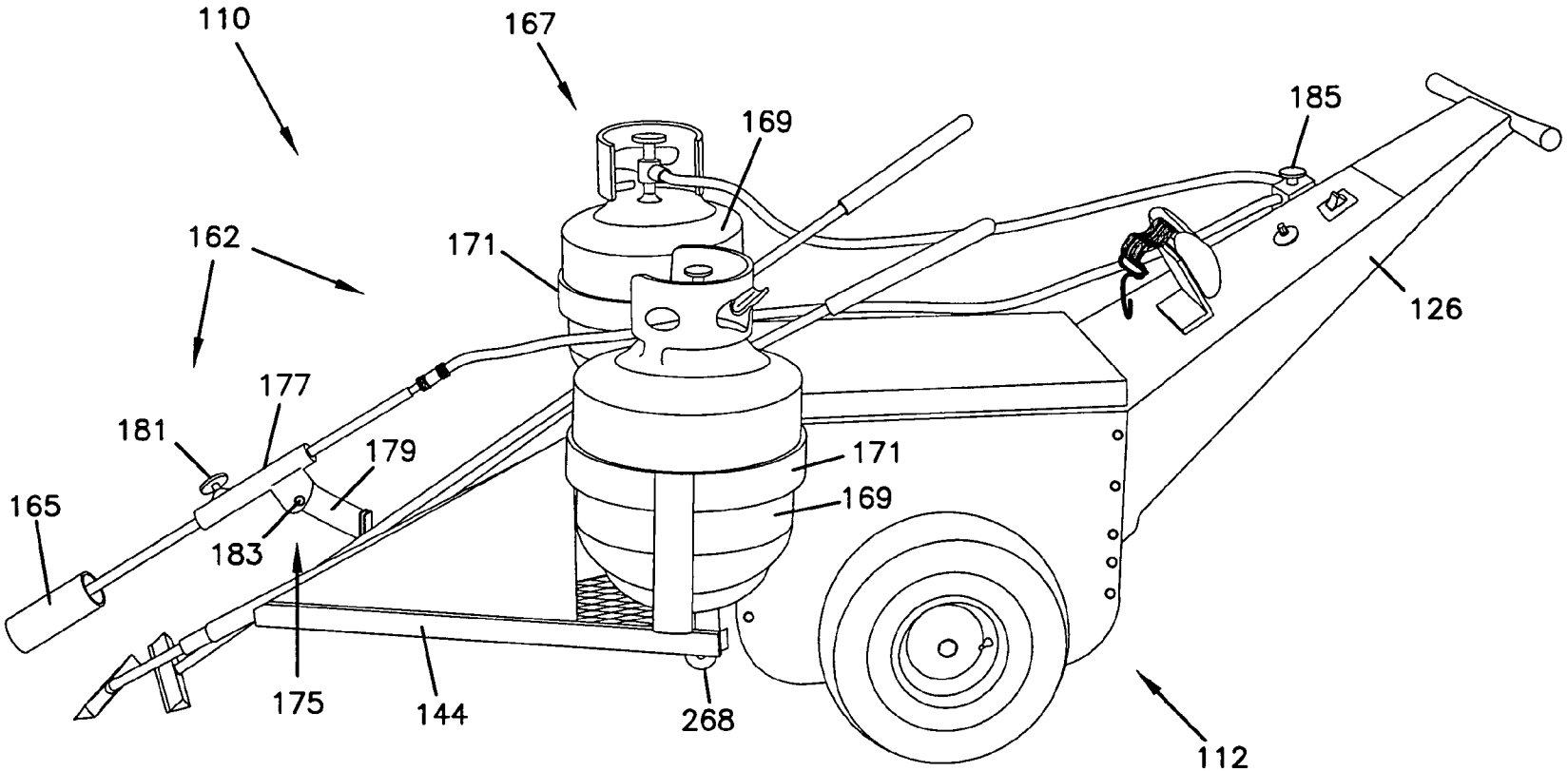
FIG. 11 is a side perspective view of the scraper apparatus of FIG. 10.

Referring now to FIGS. 10 and 11, the scraper apparatus 110 may include a heating arrangement 162. The heating arrangement 162 can be used in applications where heat is required to set or cure the filling material 54 before scraping can be performed. In this embodiment, the heating arrangement 162 does not interchange with the scraping arrangement, but rather attaches to the frame assembly 144 of the scraping arrangement 116 so that an operator can conveniently either scrape or heat the filling material 54 as required.

The heating arrangement 162 of this embodiment includes a blower device 165 (e.g., a blow torch) and a fuel source 167. In one embodiment, a control valve 185 can be provided to control the flow of fuel between the fuel source 167 and the blower device 165, and thereby control operation of the heating arrangement 162. The control valve 185 is preferably located where easily accessible, such as on the handle portion 126 of the cart 112, for example.

One type of fuel source 167 that can be used is a propane tank 169, although other fuel sources are contemplated. Two propane tanks 169 are provided in the shown embodiment. The propane tanks 169 are mounted to the frame assembly 144 of the scraping arrangement 116 by brackets 171. The brackets 171 have a basket type configuration to hold the propane tanks. The basket type configuration permits an operator to easily replace empty propane tanks with filled tanks.

The brackets 171 attached to the mounting connections 173 (FIG. 7) located at or adjacent to the side panels 145, 147 of the frame assembly 144. In the illustrated embodiment, the mounting connections 173 include pins located adjacent to the side panels 145, 147, although other types of mounting connections 173 can be used. Preferably, the brackets 171 are detachable from the frame assembly 144 so that the scraping arrangement 116 can be used without the heating arrangement 162 if desired. In the illustrated embodiment, the brackets 171 include slots (not shown). The pins (e.g., 173) are inserted into the slots of the brackets 171 so that the brackets 171 and propane tanks 169 hang from the frame assembly 144.

The blower device 165 of the heating arrangement 162 secures to the frame assembly 144 of the scraping arrangement 116. In particular, a heater mount 175 (FIG. 11) is used to mount the heating arrangement 162 such that the blower device 165 is positioned to direct heat at the filling material 54 as the power-driven cart 112 moves along a control joint 52.

Preferably, the heater mount 175 is constructed so that the position and orientation of the blower device 165 relative to the control joint 52 is adjustable. In the illustrated embodiment, for example, the heater mount 175 includes a sleeve 177 pivotally connected to a bracket 179. The bracket 179 is secured to a front plate 137 (FIG. 9) of the frame assembly 144 by a fastener (not shown) for example. The blower device 165 is positioned within the sleeve 177. A securing element, such as a set knob 181 secures the blower device 165 within the sleeve 177. The outward extended position of the blower device 165 is adjustable in that the operator can slide the blower device 165 within the sleeve 177 to a desired position. The adjustability permits that operator to extend or retract the blower device as needed for the particular operational application.

In addition, the angle or orientation of the blower device 165 relative to the concrete working surface 50 is also adjustable. In particular, the blower device 165 can be pivoted about a pin connection 183 (FIG. 11) between the sleeve 177 and the bracket 179 so that the blower device 165 angles more toward or away from the working surface 50. This feature permits a user to vary the direction of heat output as needed for the particular operational application. Overall, the heater mount 175 permits an operator to control the amount of heat applied to the filling material 54 by adjusting the outward extension, and the angular orientation of the blower device 165.

Referring back to FIG. 9, the frame assembly 144 of the scraping arrangement 116 includes an adjustable wheel 117. When the scraper apparatus 10 is being used to heat the filling material 54, the wheel 117 is positioned in a lowered position to contact the concrete working surface 50. When the wheel 117 is in the lowered position, the blades 136, 138 are lifted up from the working surface 50. The heating arrangement 162 can thereby move along the crack 52 to heat or cure the filling material 54 without interference from the blades 136, 138.

When the scraper apparatus 10 is being used to scrape the filling material 54, the adjustable wheel 117 is either detached from the frame assembly 144, or positioned in a raised position so that the wheel 117 does not contact the concrete working surface 50. By detaching or raising the wheel 117, the weight of the cart 112 is carried by the blades 136, 138 to provide the shearing force, as previously discussed. In the illustrated embodiment, a securing knob 119 is used to secure the wheel 117 at one of a number of positions, including the lower position and the raised position. In alternative embodiments, the wheel 117 can be lower and raised by a hinging, pivoting, or folding bracket construction, for example.

The adjustable wheel 117 is also convenient for lifting the blades 136, 138 from the concrete surface 50 when the blades require maintenance or repair. As previously described, the blade heads 186, 188 of each of the blades 136, 138 are secured to the respective shafts 170 by fasteners 182. The adjustable wheel 117 can be positioned to lift the blades 136, 138 so that the blade heads 186, 188 can be removed and interchanged as needed. As shown in FIG. 6, the frame assembly 144 may include a tool holder 191. The tool holder 191 provides easy access to tools used for changing the blade heads 186, 188, for example.

Referring again to FIGS. 6 and 7, the wheel 117 also functions as a transport wheel to move or transport the scraping arrangement 116 when disassembled or detached from the power-driven cart 112. That is, a user can grasp and lift extended ends 176 of the shafts 170 (FIG. 7) so that the scraping arrangement 116 rests only upon the transport wheel 117 (FIG. 6). The user can then easily roll the scraping arrangement 116, like a wheel barrel, to different locations.

Alternatively, if the user does not want to lift the scraping arrangement 116, the arrangement can be rolled along the work surface on the transport wheel 117 and rear caster wheels 268 (only one shown in FIG. 11) attached to the frame assembly 144. (The rear caster wheels 268 do not contact the working surface 50 when the scraping arrangement 116 is mounted to the cart 112.)

In general, the scraper apparatus 110 is used for scraping repaired cracks or other structural defects formed in a working surface, or for scraping filled control joints formed in a working surface. However, prior to filling and scraping operations, often the crack or joint 52 is first "cleaned" to remove dirt and loose/fragmented concrete pieces, for example, and/or to provide a more uniform crack volume. The cracks or joints are typically "cleaned" with a saw blade.

Figure 12:
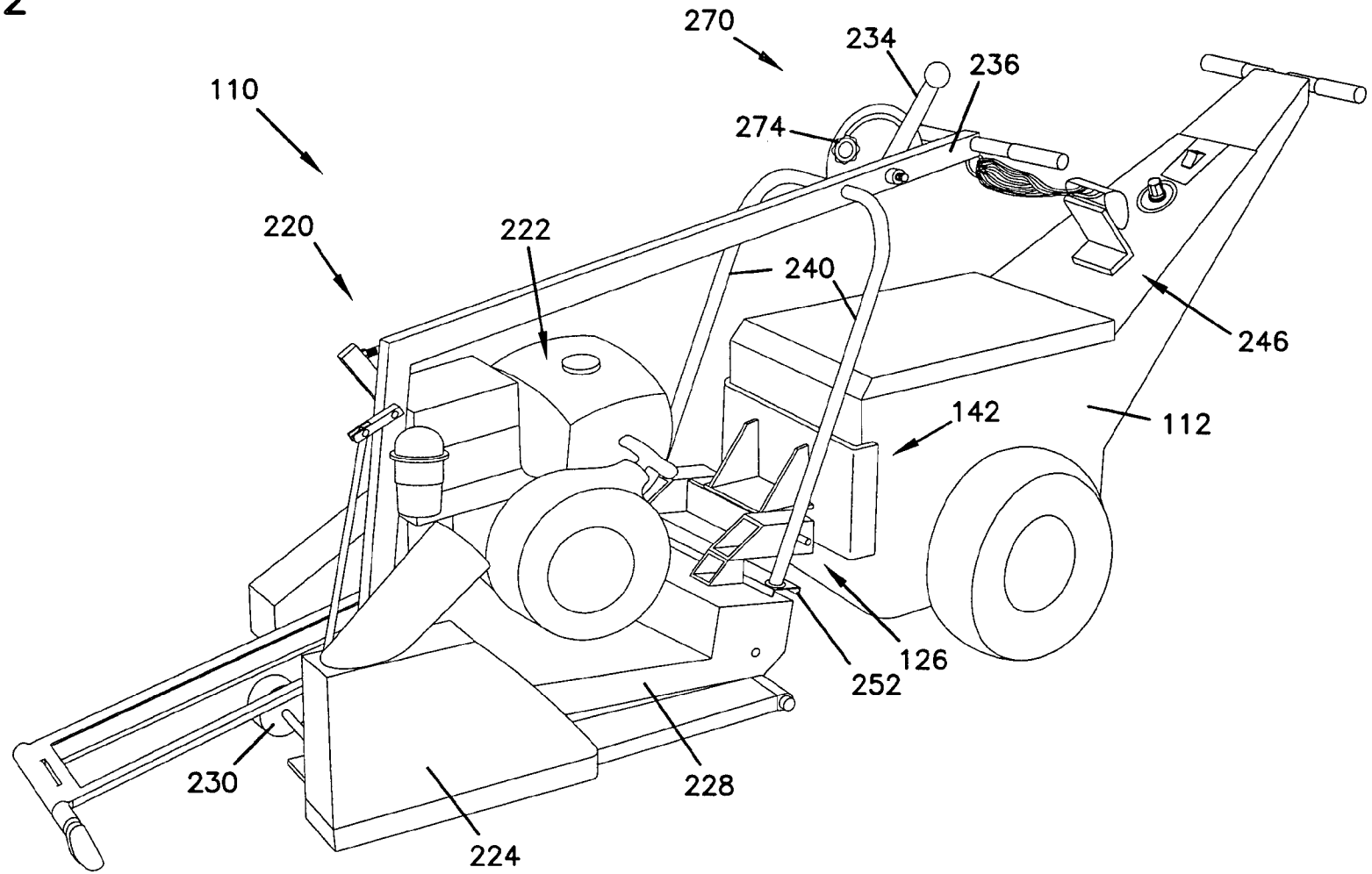
FIG. 12 is a front perspective view of an embodiment of a power saw arrangement attached to the power cart of FIG. 8 according to the principles of the present invention.

Referring now to FIG. 12, the scraper apparatus 110 of the present disclosure is also constructed for use with a power saw arrangement 220. The power saw arrangement 220 includes a motor or engine 222 that rotates a blade of a saw (not shown) enclosed within a shroud 224. The engine 222 is mounted to a base 228 supported by front wheels 230 (FIG. 14) and rear wheels (not shown). A lever 234 located on a handle 236 of the power saw arrangement 220 engages and disengages the saw blade with the working surface 50 (i.e., lifts and lowers the saw blade relative to the working surface).

Figure 14:
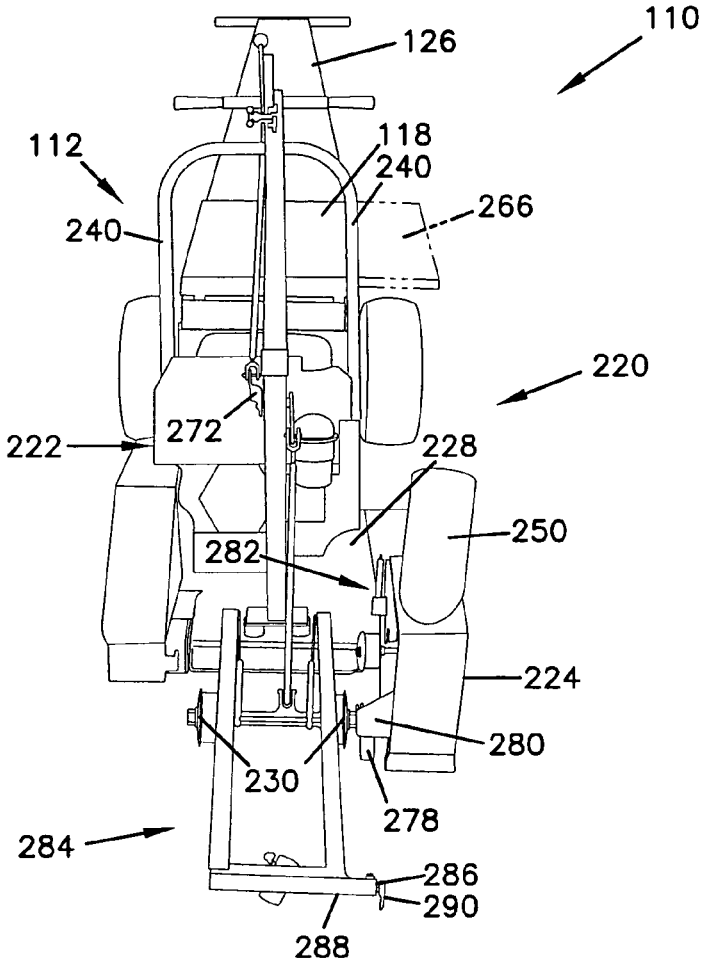
FIG. 14 is a front perspective view of the power saw arrangement of FIG. 12.
Figure 15:
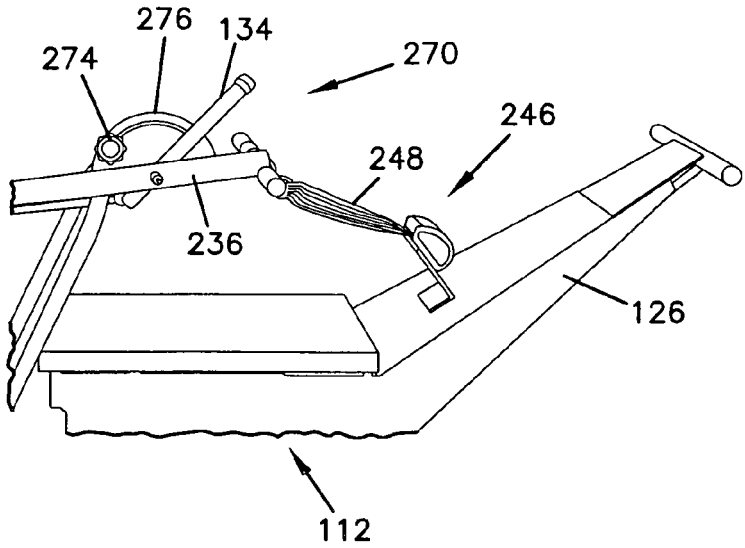
FIG. 15 is a partial, side perspective view of the power saw arrangement of FIG. 12.

Referring to FIGS. 12 and 15, the depth of engagement of the saw blade is selectively controlled by a depth control mechanism 270. The depth control mechanism 270 is interconnected to the front wheels 230 of the base 228 by a linkage 272 (FIG. 14). To adjust the depth of saw blade engagement, a user selectively positions a knob 274 of the depth control mechanism 270 at a desired location within a slot 276 of the mechanism 270. As can be understood, the knob 274 can be positioned at any one of many locations defined by the slot 276.

The location of the knob 274 within the slot 276 correspondingly positions the front wheels 230 of the base 228 relative to the working surface 50 via the linkage 272. In turn, the position of the front wheels 230 corresponds to the depth of engagement of the saw blade. In FIG. 15, the lever 234 is shown in a position wherein the saw blade is lifted from contact with the working surface. To lower the saw blade, the lever 234 is moved forward until the lever 234 contacts the knob 274. The knob 274 thereby functions as a selectively adjustable stop that limits the depth of engagement of the saw blade.

In conventional use, such power saw arrangements are physically pushed by an operator during cutting operation. Pushing a saw arrangement can be very laborious, as traditionally the saw blades are up-cut blades that generate a reaction force in a direction opposite the direction of travel of the saw arrangement. The scraper apparatus 110 of the present disclosure, however, eliminates the labor involved in physically pushing the power saw arrangement 220. That is, the present invention also relates to a saw mounting bracket 226 (FIG. 12) and a tie-down arrangement 246 that can be used with conventional power saw arrangements. The saw mounting bracket 226 and the tie-down arrangement 246 are constructed and arranged to operably mount the saw arrangement 220 to the cart 112 so that the conventional power saw arrangement can be power-driven.

Figure 13:
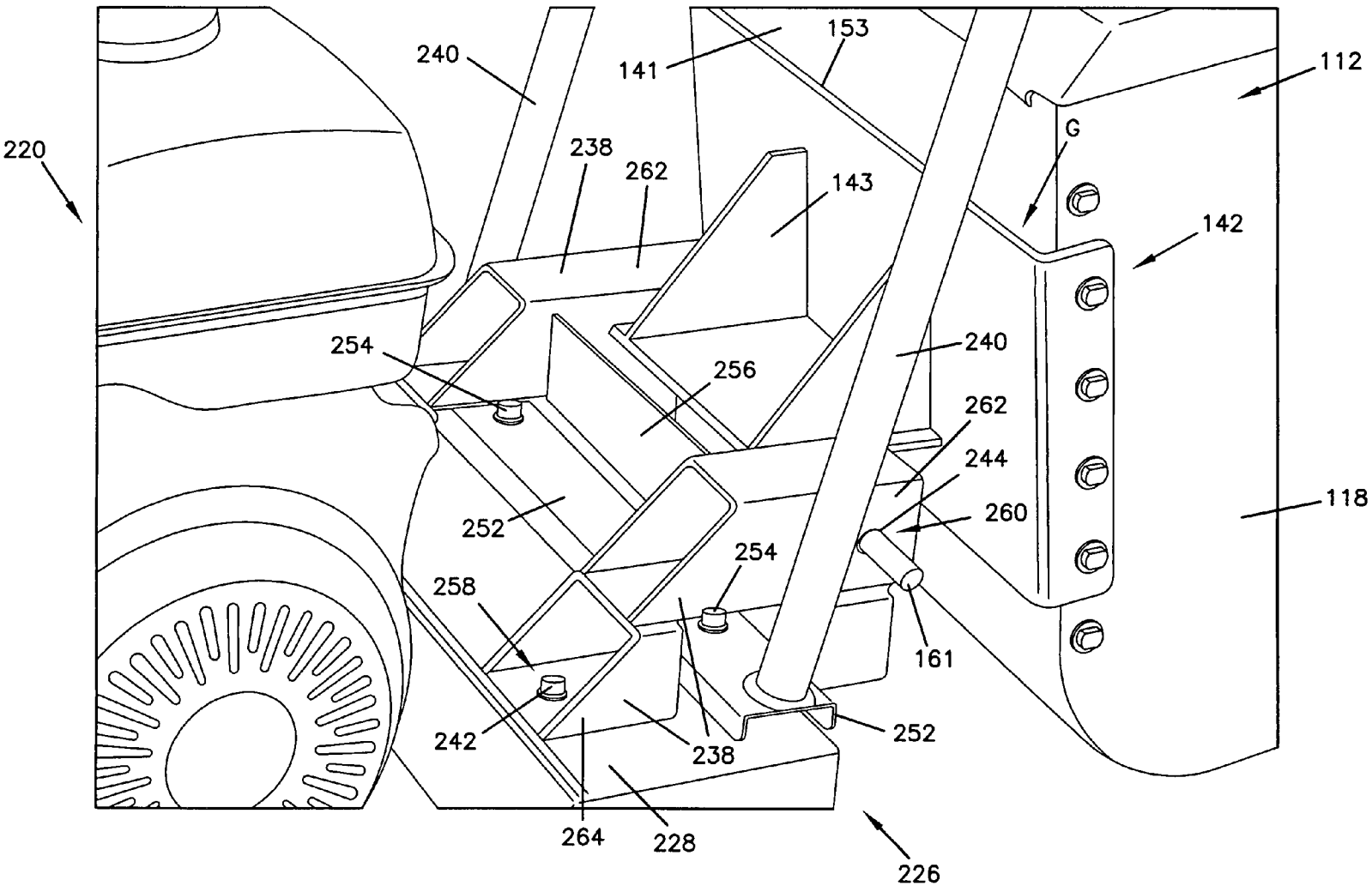
FIG. 13 is a partial, side perspective view of a frame assembly of the power saw arrangement of FIG. 12.

As shown in FIG. 13, the saw mounting bracket 226 includes first and second bracket members 238. Each of the first and second bracket members 238 provides a base mounting connection 258 and a cart mounting connection 260. The base mounting connections 258 couple the saw mounting bracket 226 to the base 228, and the cart mounting connections 260 couple the saw mounting bracket 226 to the mounting structure 142 of the cart 112. In the illustrated embodiment, the cart mounting connections 260 are located on a first main portion 262 of the first and second bracket members 238. The base mounting connections 258 are located on a second offset portion 264 of the bracket members 238. Preferably, each of the base and cart mounting connections 258, 260 of the saw mounting bracket 226 are easily detachable and accessible so that an operator can quickly interchange the power saw arrangement 220 and the scraping arrangement 116 as needed.

Still referring to FIG. 13, the first and second bracket members 238 are sized to fit between the arms 240 of the conventional saw arrangement 220. The conventional saw arrangement also includes a cross support 252 which extends between the arms 240 and fastens to the base 228 of the saw arrangement (e.g. by fasteners 254). The bracket members 238 are also sized to accommodate the cross support 252 of the conventional power saw arrangement 220. That is, the first main portion 262 and the second offset portion 264 define a notch-like construction that receives or fits over the cross support 252 of the power saw arrangement 220. It is contemplated that bracket members having other shaped constructions, such as more U-shaped brackets or an L-shaped bracket can be used.

A cross member 256 of the illustrated saw mounting bracket 226 is interconnected to both the first main portions 262 of the first and second bracket members 238. The cross member 256 provides structural support to the overall saw mounting bracket 226. To mount the power saw arrangement 220 to the power cart 112, the second offset portions 264 of the saw mounting bracket 226 are coupled to the base 228 by fasteners 242, for example. The saw mounting bracket 226 is then coupled to the mounting structure 142 of the cart 112. In particular, the sleeve 163 (FIG. 8) of the mounting structure 142 is positioned between the first and second bracket members 238 so that the sleeve 163 aligns with holes 244 formed in each of the bracket members 238. The rod 161 (used to also mount the scraping arrangement 116) is then inserted through the holes 244 of the bracket members 238 and through the sleeve 163 to secure the power saw arrangement 220 to the cart 112.

Referring now to FIG. 14, the shroud 224 of the illustrated power saw arrangement 220 is coupled to the base 228 by a sleeve and pin connection 282. As shown, the saw and the shroud 224 are laterally offset and located at a distance forward of the base 228 (FIG. 12). The extended distance of the saw and shroud forward of the base 228 is greater in comparison to conventional arrangement so that the operator can view the shroud 224 and working surface 50 adjacent the shroud when standing behind the power cart 112. Because of the extended forward positioning of the saw and shroud 224, the illustrated power saw arrangement 220 includes a support wheel 278. The support wheel 278 is coupled to the shroud by a bracket 280 and supports the weight of the structure extending forward of the base 228.

The power saw arrangement 220 further includes a line guide arrangement 284. The line guide arrangement 284 includes a telescoping arm 286 that extends from and retracts into a sleeve 288. A finger 290 is located at a free end of the arm 286. In use, the arm 286 can be extended from the sleeve 288 a distance so that the finger 290 aligns with the blade of the saw. In use, the operator maintains the alignment of the finger 290 with the crack or joint 52 in the working surface 50; and correspondingly, maintains alignment of the saw blade with the crack or joint.

Referring again to FIG. 15, the tie-down arrangement 246 of the apparatus 110 includes a strap 248 that is connected to the handle portion 126 of the cart 112. During use of the power saw arrangement 220, the strap 248 of the tie-down arrangement 246 is attached to the handle 236 of the saw arrangement.

Essentially, the tie-down arrangement functions as a safety device to limit the pivotal movement of the power saw arrangement 220. That is, the power saw arrangement 220 is rigidly attached to the saw mounting bracket 226, yet can pivot about the cart mounting connection 260. In particular, the rod 161 (FIG. 13) that couples the saw mounting bracket 226 to the cart 112 acts as a pin joint so that the saw arrangement 220 can pivot upward about the pin joint. As previously discussed, traditionally the saw blades are up-cut blades that generate a force which can cause the power saw arrangement to buck or pivot upward about the pin joint. When the strap 248 is tied or secured to the handle 236 of the power saw arrangement 220, the strap 248 of the tie-down arrangement limits the range of pivotal movement of the power saw arrangement 220.

The tie-down arrangement 246 can also be used to lift the wheels 230 of the power saw arrangement from the working surface to aid in maneuvering or turning the apparatus 110. In particular, the strap 248 can be tightened so only the rear wheels (not shown) of the power saw arrangement 220 located adjacent to the saw mounting bracket 226 contact the working surface. Lifting the front wheels 230 from the working surface permits the operator to more easily maneuver the apparatus 110. For example, when the front wheel 230 bear the weight of the power saw arrangement 220, the entire apparatus (112 and 220) has a wheel base length (i.e., from saw arrangement wheels 230 to cart wheels 134) that can be difficult to turn. Lifting the front wheels 230 via the tie-down arrangement 246 provides a shorter wheel base so that the entire apparatus is more easily maneuvered. Preferably, the strap 248 of the tie-down arrangement 246 is retractable so that the strap 248 can be stored when the saw arrangement 220 is not mounted to the cart 112.

Referring again to FIG. 14, the apparatus 110 can further include a detachable platform 266 (shown schematically in dashed lines) upon which a vacuum (not shown) can be secured. In the illustrated embodiment, the platform 266 attaches to the main body 118 of the power cart 112. In use, a vacuum tube of the vacuum attaches to an exhaust port 250 formed in the shroud 224 of the power saw arrangement 220. The vacuum is then used to evacuate particles, such as concrete pieces and concrete dust, created during cutting operations. The platform 266 can also be used to hold or mount a generator that powers the vacuum or that charges the battery of the power cart, for example.

As previously described, the devices and methods of the present disclosure can be used in removing excess filling material from a joint or crack formed in a working surface. It is contemplated that the principles relating to the disclosed devices and methods can also be used in other applications such as removal of carpet, tile, linoleum, wooden flooring, or ice from outdoor surfaces.

The above specification, examples and data provide a complete description of the invention. Since many embodiments of the invention can be made without departing from the spirit and scope of the invention, the invention resides in the claims hereinafter appended.

What is claimed is:

1. A method of filling joints or cracks formed in a surface, the method comprising the steps of:

a) providing a scraping machine including a power-driven cart and blades mounted to the power driven cart;

b) filling a joint or crack with a filling material;

c) positioning the blades of the scraping machine at the filled joint or crack;

d) advancing the power-driven cart along the surface, the power-driven cart forcibly driving the blades of the scraping machine along the filled joint or crack; and e) removing excess filling material with the blades, the excess filling material located above a volume defined by the joint or crack formed in the surface.

2. The method of claim 1, further including permitting the filling material to harden prior to removing the excess filling material.

3. The method of claim 1, wherein the filling material remaining within the joint or crack, after removing the excess filling material, is at or below the surface.

4. The method of claim 1, further including permitting the filling material to expand, and removing the excess portion of material that has expanded beyond the volume defined by the joint or crack formed in the surface.

* * * * *